US011986046B2

(12) United States Patent
Cin et al.

(10) Patent No.: US 11,986,046 B2
(45) Date of Patent: May 21, 2024

(54) FOOTWEAR SOLE STRUCTURE WITH NESTED FOAM CORE

(71) Applicant: NIKE, Inc., Beaverton, OR (US)

(72) Inventors: David Jonathan Cin, Portland, OR (US); Jamie Y. Mak, Beaverton, OR (US); Rachel Nichols, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 66 days.

(21) Appl. No.: 17/179,096

(22) Filed: Feb. 18, 2021

(65) Prior Publication Data

US 2021/0307452 A1 Oct. 7, 2021

Related U.S. Application Data

(60) Provisional application No. 63/006,286, filed on Apr. 7, 2020.

(51) Int. Cl.

| | |
|---|---|
| ***A43B 13/12*** | (2006.01) |
| ***A43B 13/18*** | (2006.01) |
| *A43B 13/04* | (2006.01) |
| *A43B 13/32* | (2006.01) |

(52) U.S. Cl.

CPC ..... *A43B 13/125* (2013.01); *A43B 13/122* (2013.01); *A43B 13/187* (2013.01); *A43B 13/04* (2013.01); *A43B 13/32* (2013.01)

(58) Field of Classification Search

CPC ... A43B 13/187; A43B 13/125; A43B 7/1445; A43B 13/184; A43B 13/181; A43B 13/32; A43B 23/088; A43B 13/145; A43B 13/12

USPC ..... 36/25

See application file for complete search history.

(56) References Cited

U.S. PATENT DOCUMENTS

| | | | | |
|---|---|---|---|---|
| 6,665,958 | B2 | 12/2003 | Goodwin | |
| 7,464,489 | B2 * | 12/2008 | Ho | A43B 13/181 36/35 B |
| 7,748,143 | B2 * | 7/2010 | Mathieu | A43B 13/12 36/31 |
| 8,069,585 | B2 | 12/2011 | Rohwer-Kahlmann | |

(Continued)

FOREIGN PATENT DOCUMENTS

| | | |
|---|---|---|
| CN | 100425175 C | 10/2008 |
| CN | 106539186 A | 3/2017 |

(Continued)

OTHER PUBLICATIONS

Seo, Woo Seung, Functional Shoe Product, May 30, 2013 , WO 2013077642 A1, Korea.*

*Primary Examiner* — Alissa J Tompkins
*Assistant Examiner* — Tin Htwe Oo
(74) *Attorney, Agent, or Firm* — Quinn IP Law

(57) ABSTRACT

A sole structure for an article of footwear may include a sole component having a bottom wall and a peripheral wall extending upward from the bottom wall and partially surrounding a space above the bottom wall. The sole structure may have a midsole that includes a foam core nested in the space. The peripheral wall of the sole component may be disposed outward of a side surface of the foam core. The sole component may be attached to a first portion of the side surface and detached from a second portion of the side surface. The second portion of the side surface may be disposed between the first portion and the bottom wall.

19 Claims, 12 Drawing Sheets

(56) References Cited

U.S. PATENT DOCUMENTS

| | | | | |
|---|---|---|---|---|
| 8,082,686 | B2 | 12/2011 | Campbell et al. | |
| 8,869,435 | B2 | 10/2014 | Hatfield et al. | |
| 9,456,658 | B2 | 10/2016 | Bruce et al. | |
| 9,521,877 | B2 | 12/2016 | Campos, II et al. | |
| 10,010,133 | B2 | 7/2018 | Guyan | |
| 2004/0045192 | A1 | 3/2004 | Lin | |
| 2016/0128424 | A1 | 5/2016 | Connell et al. | |
| 2016/0278481 | A1 | 9/2016 | Le et al. | |
| 2018/0103727 | A1* | 4/2018 | Fracassi | A43B 23/026 |
| 2018/0213886 | A1 | 8/2018 | Connell et al. | |
| 2018/0263333 | A1 | 9/2018 | Adeagbo et al. | |
| 2018/0338567 | A1 | 11/2018 | Xanthos | |
| 2019/0320759 | A1 | 10/2019 | Conrad et al. | |
| 2021/0120913 | A1 | 4/2021 | Blanche et al. | |
| 2021/0368916 | A1* | 12/2021 | Wakasugi | A43B 13/14 |

FOREIGN PATENT DOCUMENTS

| | | | |
|---|---|---|---|
| EP | 2424398 | B1 | 12/2015 |
| KR | 101047352 | B1 | 7/2011 |
| KR | 20130025050 | A | 3/2013 |
| TW | 201544028 | A | 12/2015 |
| TW | 201737823 | A | 11/2017 |
| TW | 201919504 | A | 6/2019 |
| WO | 9203069 | A1 | 3/1992 |
| WO | WO 2013077642 | A1 * | 2/2013 |
| WO | 2013077642 | A1 | 5/2013 |

* cited by examiner

FOOTWEAR SOLE STRUCTURE WITH NESTED FOAM CORE

CROSS-REFERENCE TO RELATED APPLICATION

This application claims the benefit of priority to U.S. Provisional Application No. 63/006,286, filed Apr. 7, 2020, which is hereby incorporated by reference in its entirety.

TECHNICAL FIELD

The present disclosure generally relates to a sole structure for an article of footwear that includes a form core nested in a sole component.

BACKGROUND

Footwear sole structures are often composed of multiple components of different materials in order to meet durability, stability, and cushioning goals. For example, some components may have high energy return and elastic resiliency under compressive loading, while other components may have less elastic resiliency but greater abrasion resistance. Footwear manufacturers strive to design and assemble the various components to enable each to achieve its functionality.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
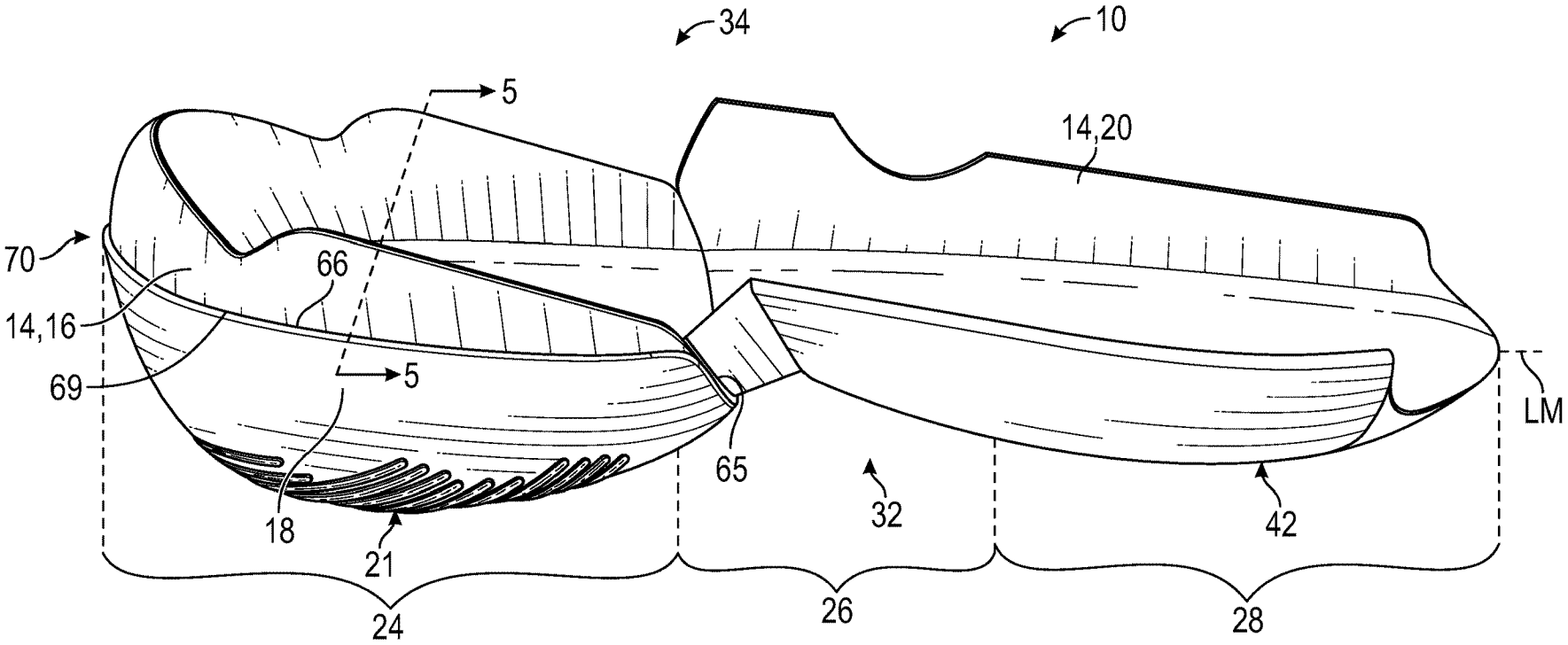
FIG. 1 is a perspective view showing a medial side of a sole structure for an article of footwear.

The present disclosure generally relates to a sole structure for an article of footwear. The sole structure has a foam core with relatively high energy return and cushioning ability and is configured and constructed to protect the foam core from wear while minimizing constraint of the foam core so that its cushioning advantages may be more fully realized.

The sole structure may comprise a sole component that has a bottom wall and a peripheral wall that extends upward from the bottom wall and partially surrounds a space above the bottom wall. The sole structure may further comprise a midsole that includes a foam core disposed in the space. The peripheral wall of the sole component may be disposed outward of a side surface of the foam core. The sole component may be attached to a first portion of the side surface and detached from a second portion of the side surface disposed between the first portion and the bottom wall. For example, the second portion of the side surface may be free from any attachment within the space. With this configuration, the foam core is sufficiently secured to the sole component to ensure stability of the sole structure while still allowing a portion of the foam core to resiliently deform at least under an initial stage of loading without interference from or constraint by the sole component.

In an implementation, the foam core may have a first stiffness and the sole component may have a second stiffness greater than the first stiffness. Accordingly, the relatively compliant foam core may be protected by the stiffer sole component by nesting the foam core within the space defined by the sole component. As used herein, "stiffness" is the rate of change of load to displacement in compression of a component such as when the component is under a dynamic compressive load due to impact with the ground. A component may have a constant stiffness (i.e., linear rate of change of load to displacement), a non-linear stiffness, such as an exponentially increasing rate of change of load to displacement in compression, or may have a rate that is initially linear and changes to non-linear or vice versa. The stiffness of the sole structure described herein may have an effective stiffness in a portion of the displacement range that is based on the stiffness values of more than one of the components of the sole structure when, for example, one of the components (e.g., the sole component) physically restrains another one of the components (e.g., the foam core) from resiliently deforming under compression.

In an aspect, the sole structure may further comprise an adhesive layer disposed on the first portion of the side surface of the foam core and adhering the sole component to the first portion of the side surface of the foam core. The second portion may be free of adhesive as the second portion may be free from securement to the sole component or any other component of the sole structure.

In another aspect, the second portion of the side surface of the foam core may be recessed inward from the first portion, defining a gap between an inner side of the peripheral wall of the sole component and the second portion of the side surface of the foam core. The foam core may expand without constraint within the gap under compressive loading, allowing its desirable cushioning properties to be achieved. For example, the second portion of the side surface of the foam core may compress outward freely under dynamic compressive loading until it contacts and compresses against the inner side of the peripheral wall of the sole component, filling or substantially filling the gap. Because the second portion may be between the first portion and the bottom wall, e.g., below the first portion, more of the dynamic movement of the foam core is closer to the ground during wear, increasing stability of the sole structure.

In an aspect, the side surface of the foam core may extend along a medial side, a lateral side, and a rear of the sole structure. The peripheral wall of the sole component may extend adjacent to and outward of the side surface of the foam core at the medial side, the lateral side, and the rear of the sole structure. Accordingly, the peripheral wall effectively cages in and protects the foam core at the medial side, the lateral side, and the rear of the foam core. In an implementation, the peripheral wall of the sole component may have a notch extending from an upper edge of the peripheral wall to the bottom wall of the sole component at the rear of the sole structure. The foam core may extend across the notch inward of the peripheral wall. The notch may provide increased flexibility in a transverse direction of the sole structure in comparison to an embodiment without a notch (e.g., the medial side of the sole structure may flex more readily relative to the lateral side of the sole structure in the vicinity of the notch).

The relative shapes and surface areas of the first portion and the second portion may be different in various implementations. For example, in an implementation, the first portion of the side surface of the foam core may include an elongated strip that has a first leg extending from a bottom surface of the foam core toward a top edge of the foam core, a second leg extending from the first leg around the foam core to a rear of the foam core, and a third leg at the rear of the foam core and extending from the second leg toward the bottom surface of the foam core. The second portion may extend from the first leg to the third leg between the second leg and the bottom surface of the foam core. For example, the second portion may extend in an uninterrupted span between the first leg and the third leg. In a configuration, a minimum height of the second portion may be greater than a maximum height (e.g., in a vertical direction) of the second leg.

In some implementations, the first portion may extend along the medial side, the lateral side, and the rear of the foam core. For example, the elongated strip may be a medial side elongated strip at a medial side of the foam core, and the first portion of the side surface of the foam core may further include a lateral side elongated strip at a lateral side of the foam core. The lateral side elongated strip may have a first leg at the lateral side of the foam core and extending from the bottom surface of the foam core toward the top edge of the foam core, a second leg extending from the first leg around the foam core to the rear of the foam core, and a third leg at the rear of the foam core and extending from the second leg toward the bottom surface of the foam core. In such an implementation, the second portion of the side surface of the foam core may further extend at the lateral side of the foam core from the first leg to the third leg between the second leg of the lateral side elongated strip and the bottom surface of the foam core.

In another aspect, the bottom wall of the sole component may have a through hole and the foam core may extend over the through hole. Accordingly, some freedom of movement of the foam core during compression is afforded at the bottom of the foam core as well.

In an implementation, the sole component may be an outsole that includes a ground contact surface of the sole structure. The outsole may be a durable material selected to withstand wear while protecting the foam core. For example, the outsole may be rubber and the foam core may be Pebax® thermoplastic elastomer foam and may be sold under the tradename ZoomX by Nike, Inc.

In a configuration, the sole structure may further comprise a midsole layer extending between a top surface of the sole component and a bottom surface of the foam core. The bottom surface of the foam core may be secured to a top surface of the midsole layer, and a bottom surface of the midsole layer may be secured to the top surface of the sole component. In an implementation, the foam core and the sole component may be disposed in a heel region of the sole structure, and the midsole layer may extend forward from between the foam core and the sole component in the heel region. For example, the midsole layer may extend to a midfoot region and a forefoot region of the sole structure in addition to the heel region.

In addition to being secured to the bottom surface of the foam core, the midsole layer may be secured to the side surface of the foam core. For example, the side surface of the foam core may have a third portion below the second portion. The third portion may be recessed inward relative to the second portion. The midsole layer may be bonded to the third portion of the foam core. The side surface of the foam core may define a waved edge between the second portion and the third portion. The midsole layer may have a waved upper edge that mates with the waved edge of the side surface of the foam core.

In a configuration, a sole structure for an article of footwear may comprise an outsole having a bottom wall and a peripheral wall extending upward from the bottom wall and partially surrounding a space above the bottom wall, the peripheral wall forming a cup around a rear of a heel region of the sole structure from a medial side of the sole structure to a lateral side of the sole structure. The sole structure may further comprise a midsole including a foam core nested in the space, the foam core having a side surface with a first portion and a second portion recessed inward from the first portion at both a medial side and a lateral side of the foam core defining a gap between an inner side of the peripheral wall of the outsole and the second portion of the foam core at each of the lateral side and the medial side of the foam core. The midsole may include a midsole layer disposed between the foam core and the bottom wall of the outsole, the midsole layer secured to a bottom surface of the foam core and to a top surface of the bottom wall of the outsole. The peripheral wall of the outsole may be disposed outward of the medial side of the foam core and outward of the lateral side of the foam core. The peripheral wall of the outsole may be attached to the first portion of the side surface of the foam core at the medial side and the lateral side of the foam core, and detached from the second portion of the side surface of the foam core at the medial side and the lateral side of the foam core.

The above features and advantages and other features and advantages of the present teachings are readily apparent from the following detailed description of the modes for carrying out the present teachings when taken in connection with the accompanying drawings. It should be understood that, even though in the following drawings, embodiments may be separately described, single features thereof may be combined to additional embodiments.

Figure 5:
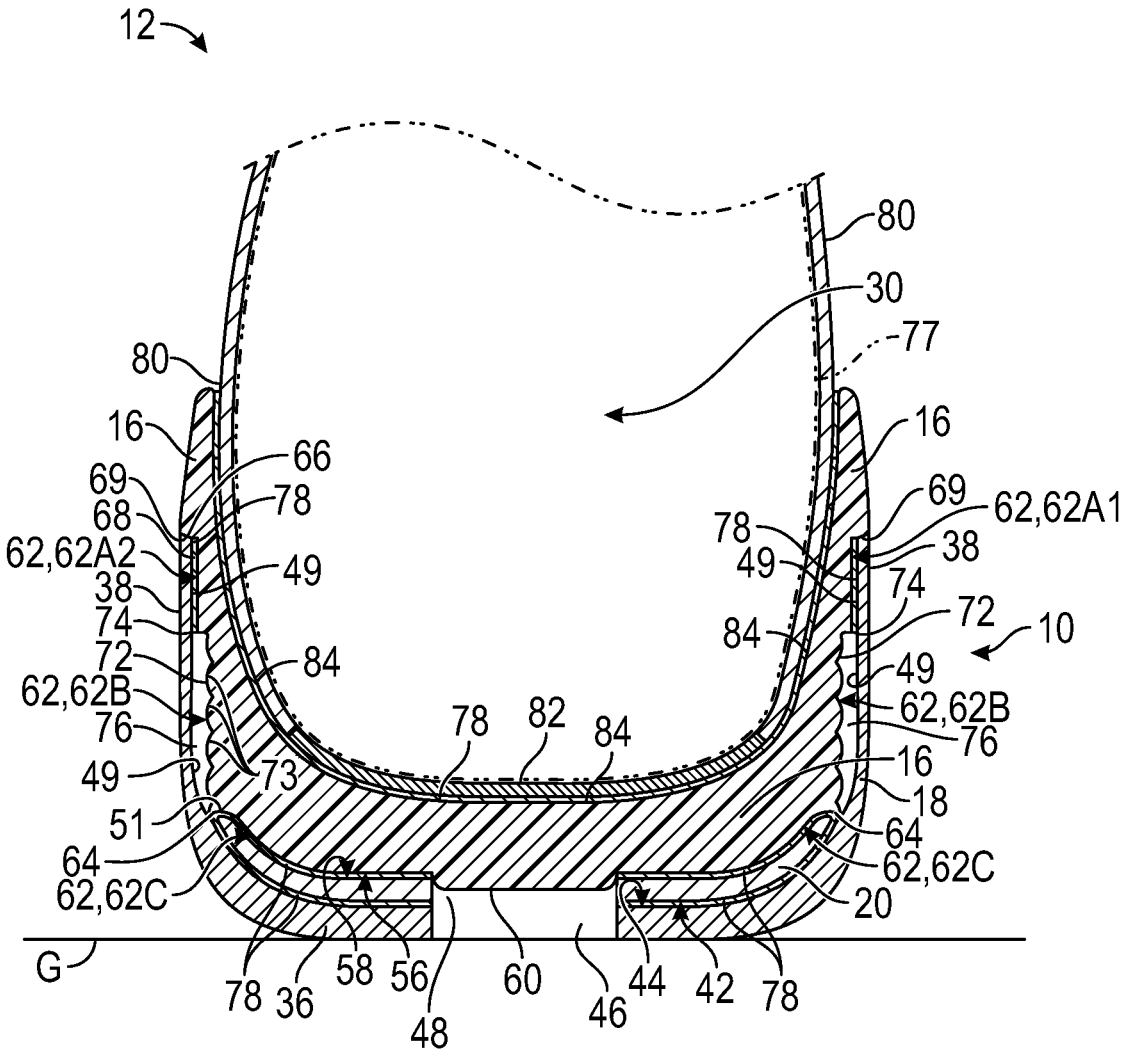
FIG. 5 is a cross-sectional view of an article of footwear that includes the sole structure of FIG. 1 taken at lines 5-5 in FIG. 1 and showing a footwear upper, with the sole structure under steady state loading.
Figure 6:
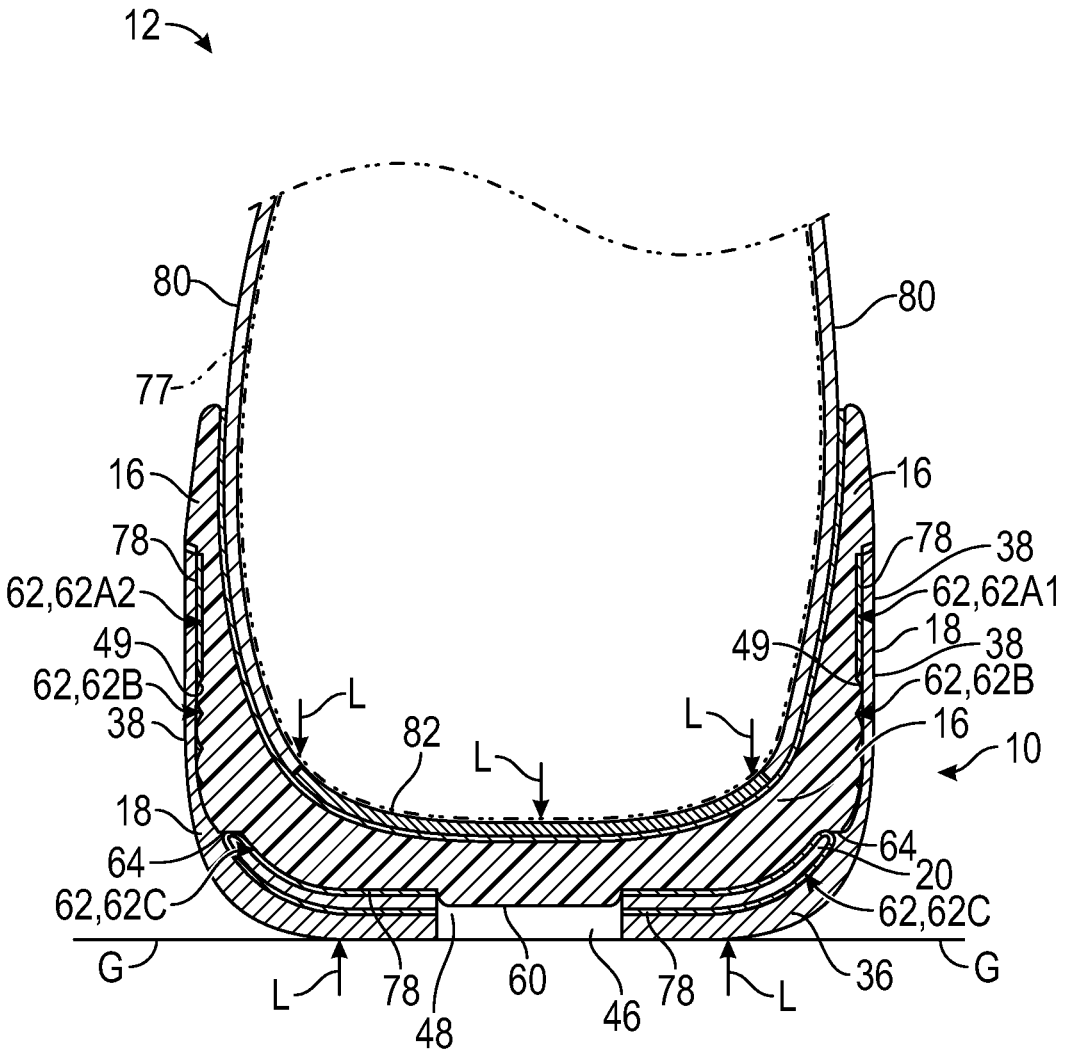
FIG. 6 is the cross-sectional view of the article of footwear of FIG. 5, with the sole structure under dynamic compressive loading.
Figure 7:
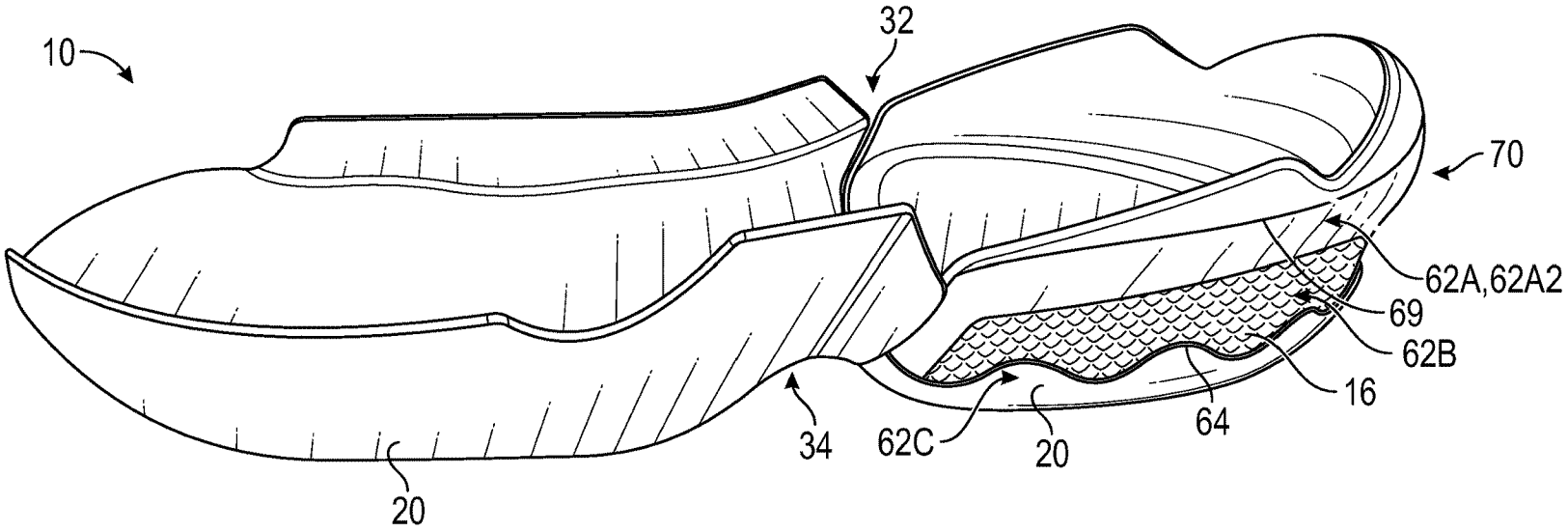
FIG. 7 is a perspective view showing the lateral side of the sole structure with an outsole component removed.
Figure 8:
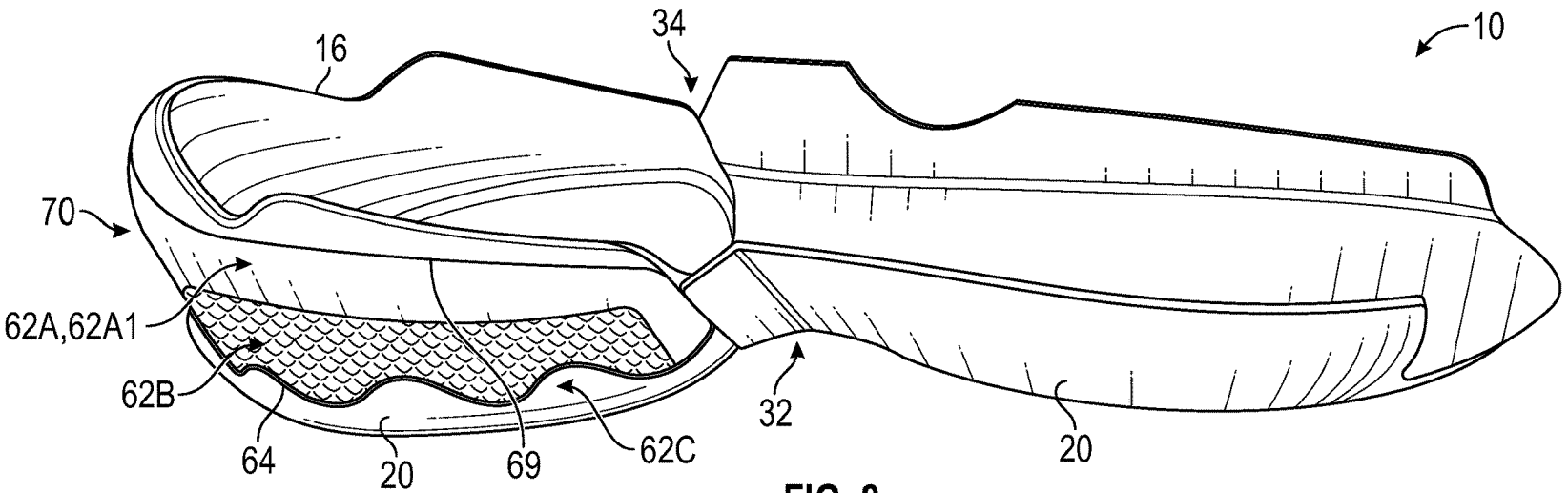
FIG. 8 is a perspective view showing the medial side of the sole structure with the outsole component removed.

Referring to the drawings, wherein like reference numbers refer to like components throughout the views, FIG. 1 shows a sole structure 10 for an article of footwear, such as the article of footwear 12 of FIGS. 5 and 6. The sole structure 10 has a midsole 14 that includes a foam core 16 nested in a sole component 18 as described herein. In the embodiment shown, the midsole 14 also includes a midsole layer 20 that is disposed between the foam core 16 and the sole component 18 as described in FIGS. 5 and 6, for example. The sole component 18 is configured as an outsole component with a ground-engaging surface 21, and may be referred to herein as an outsole component 18. An additional outsole component 94 shown in FIG. 14 may underlie the forefoot portion of the midsole layer 20. In some embodiments, the outsole components 18, 94 may be integrated as a one-piece outsole.

The foam core 16 may be a softer (less stiff) material than the outsole component 18. For example, the foam core 16 may include a foamed polymeric material and may be at least partially a polyurethane (PU) foam, a polyurethane ethylene-vinyl acetate (EVA) foam, and may include heat-expanded and molded EVA foam pellets. The foam core 16 may comprise Pebax® thermoplastic elastomer foam and may be sold under the tradename ZoomX by Nike, Inc. The midsole layer 20 may be any of these foamed polymeric materials, and may have a different compressive stiffness than the foam core 16. The outsole component 18 may be a more durable material than the foam core 16. For example, the outsole component 18 may include a rubber material than may be a natural rubber, or a synthetic rubber, or a combination of both. Examples of types of rubbers include butadiene rubber, styrene-butadiene (SBR) rubber, butyl rubber, isoprene rubber, urethane rubber, nitrile rubber, neoprene rubber, ethylene propylene diene monomer (EPDM) rubber, ethylene-propylene rubber, urethane rubber, polynorbornene rubber, methyl methacrylate butadiene styrene (MBS) rubber, styrene ethylene butylene (SEBS) rubber, silicone rubber, and mixtures thereof. The rubber compound may be a virgin material, a regrind material, and mixtures thereof.

Figure 2:
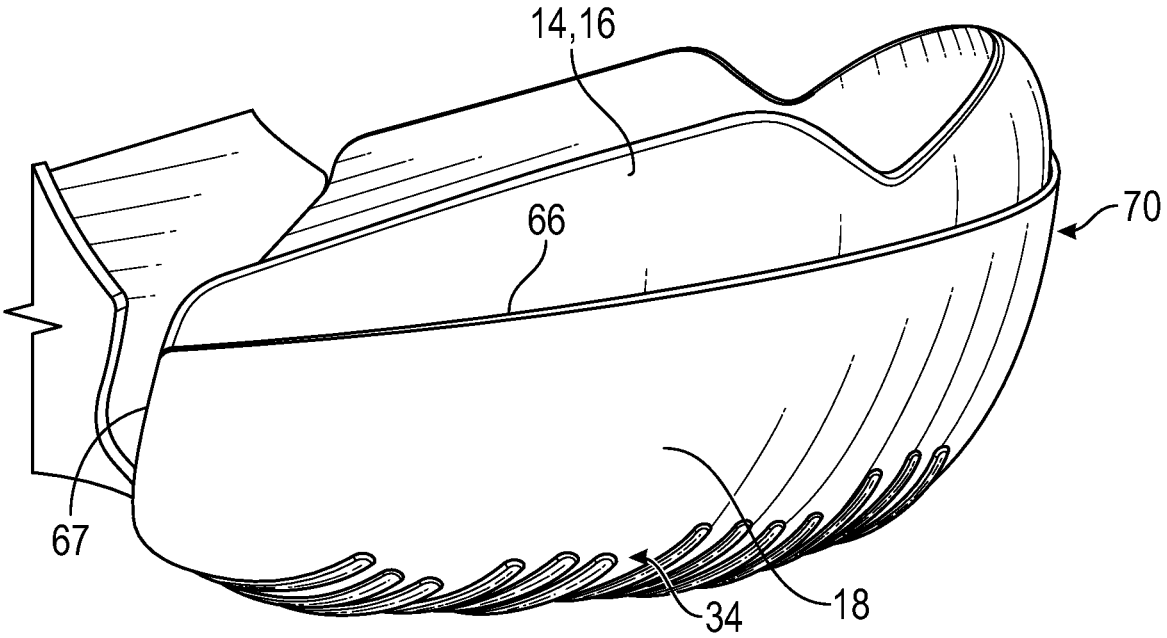
FIG. 2 is a fragmentary perspective view showing a lateral side of the sole structure.

The sole structure 10 includes a heel region 24, a midfoot region 26, and a forefoot region 28. The heel region 24 generally includes portions of the sole structure 10 corresponding with rear portions of a human foot 77, including the calcaneus bone, when the human foot of a size corresponding with the sole structure 10 is disposed in a foot-receiving cavity 30 of the article of footwear 12 and is supported on the sole structure 10 as shown in FIG. 5. The forefoot region 28 of the sole structure 10 generally includes portions of the sole structure 10 corresponding with the toes and the joints connecting the metatarsals with the phalanges of the human foot (interchangeably referred to herein as the "metatarsal-phalangeal joints" or "MPJ" joints). The midfoot region 26 of the sole structure 10 is disposed between the heel region 24 and the forefoot region 28 and generally includes portions of the sole structure 10 corresponding with an arch area of the human foot, including the navicular joint. The sole structure 10 has a medial side 32 (shown in FIG. 1) and a lateral side 34 (partially shown in FIG. 2) both of which extend from the heel region 24 to the forefoot region 28 and are generally on opposite sides of a longitudinal axis LM of the sole structure 10, which may be a longitudinal midline. The medial side 32, the lateral side 34, and a rear 70 of the sole structure 10 described herein correspond with and may also be used to indicate the medial side, the lateral side, and the rear of individual components of the sole structure 10.

Figure 3:
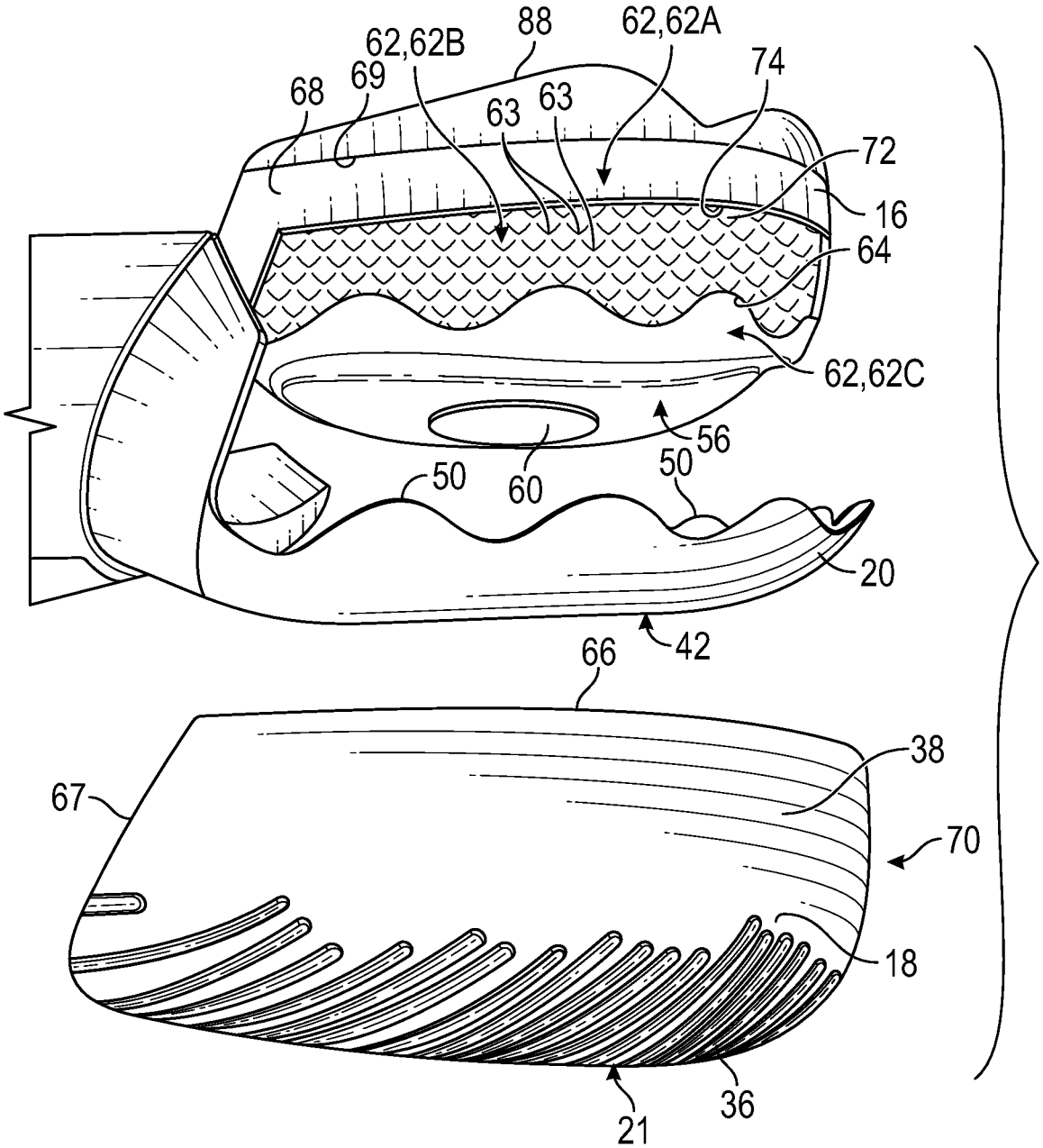
FIG. 3 is a fragmentary exploded view showing the lateral side of the sole structure.
Figure 4:
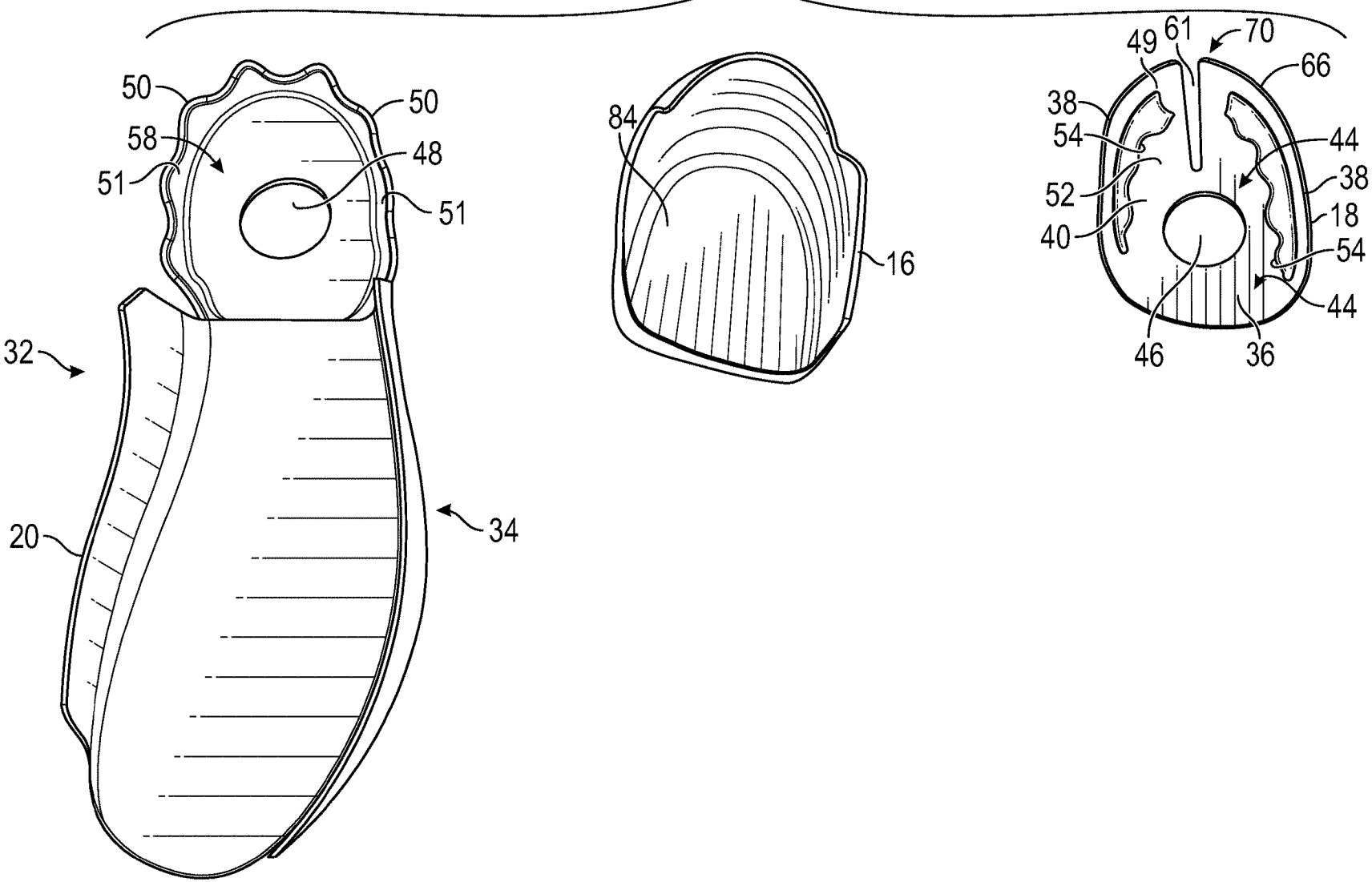
FIG. 4 is a perspective top view showing components of the sole structure in a disassembled state.

Referring to FIGS. 3 and 4, the outsole component 18 has a bottom wall 36 that includes the ground-engaging surface 21 at the bottom of the sole structure 10. The outsole component 18 includes a peripheral wall 38 that extends upward from the bottom wall 36 and partially surrounds a space 40 above the bottom wall 36. A bottom surface 42 of the midsole layer 20 is disposed in the space 40 and bonded to or otherwise secured to a top surface 44 of the outsole component 18 in the space 40, such as with adhesive (adhesive layer 78 shown in FIG. 5). A through hole 46 in the outsole component 18 is aligned with a through hole 48 in the midsole layer 20. The midsole layer 20 has a waved upper edge 50 that may fit within a slight recess 52 having a waved edge 54 at an inner side 49 of the peripheral wall 38 of the outsole component 18 (best shown in FIG. 15). The through hole 46 and the waved upper edge 50 thus serve as alignment features of the midsole layer 20 and the outsole component 18.

The foam core 16 is disposed in the space 40 with a bottom surface 56 of the foam core 16 secured to a top surface 58 of the midsole layer 20. The midsole layer 20 thus extends between the outsole component 18 and the bottom surface 56 of the foam core 16. A slight circular protrusion 60 in the bottom surface 56 may be aligned with the through holes 46 and 48.

The foam core includes a side surface 62 that has a first portion 62A, a second portion 62B disposed between the first portion 62A and the bottom wall 36 (e.g., directly below the first portion 62A), and a third portion 62C disposed between the second portion 62B and the bottom wall 36 (e.g., below the second portion 62B). The third portion 62C is recessed inward relative to the second portion 62B to define a waved edge 64 between the second portion 62B and the third portion 62C (e.g., a waved lower edge of the second portion 62B). The waved upper edge 50 of the midsole layer 20 also mates to the waved edge 64 so that the inner side 51 of the midsole layer 20 interfaces with the third portion 62C and is adhered thereto by applying adhesive to the inner side 51 and/or to the third portion 62C.

An upper edge 66 of the peripheral wall 38 of the outsole component 18 mates to the foam core 16 at a slight recess 68 of the foam core 16 that defines the top edge 69 of the first portion 62A of the side surface 62. The peripheral wall 38 of the outsole component 18 has a notch 61 extending from the upper edge 66 of the peripheral wall 38 to the bottom wall 36 of the outsole component 18 as best shown in FIG. 4. The notch 61 is disposed at a rear 70 of the assembled sole structure 10. The peripheral wall 38 and the bottom wall 36 are a unitary (one-piece) structure comprised of the same material, and the peripheral wall 38 is a continuous expanse from a front medial edge 65 (see FIGS. 1 and 15) of the peripheral wall 38 to the notch 61 at the medial side 32 of the sole component 18 and from a front lateral edge 67 (see FIGS. 3 and 15) of the peripheral wall 38 to the notch 61 at the lateral side 34 of the sole component 18. The side surface 62 of the foam core 16 extends across the notch 61 inward of the peripheral wall 38 in the assembled sole structure 10.

The side surface 62 of the foam core 16 extends along the medial side 32, the lateral side 34, and the rear 70 of the sole structure 10. The peripheral wall 38 of the outsole component 18 extends adjacent to and outward of the side surface 62 of the foam core 16 at the medial side 32, the lateral side 34, and the rear 70 of the sole structure 10. Accordingly, the peripheral wall 38 effectively cups and protects the foam core 16 at the medial side 32, the lateral side 34, and the rear 70 of the foam core 16. As shown in FIGS. 3 and 7-11, the second portion 62B may have a textured surface as indicated by a plurality of rounded protrusions 63 (some indicated with reference numbers in FIGS. 3, 5, and 9). In other embodiments, a different texture may be present, or the second portion 62B may be smooth. The texture may be rounded protrusions 63 extending into a gap 76 as shown in FIG. 5. The texture may be imparted to the foam core 16 by a mold into which the foam used to form the foam core 16 is injected or otherwise disposed during forming of the foam core 16.

Referring to FIG. 3, even with the rounded protrusions 63 of the second portion 62B, the foam core 16 has a recess 72 at the second portion 62B. The recess 72 defines a top edge 74 of the second portion 62B of the side surface 62 and extends downward to the waved edge 64. As best shown in FIG. 5, the recess 72 of the second portion 62B relative to the first portion 62A causes a gap 76 to exist between the inner side 49 of the peripheral wall 38 of the outsole component 18 and the second portion 62B of the side surface 62 of the foam core 16. Because the foam core 16 is resiliently deformable, under a sufficiently large compressive load, the foam core 16 may deform transversely outward into the gap 76 (e.g., outward at the medial side 32 and the lateral side 34) to fill or substantially fill the gap 76 such as by crossing the gap 76 into contact with the inner side 49 of the outsole 18. However, the sole structure 10 is configured so that during a steady state load of less than a predetermined amount, the gap 76 exists (e.g., is not traversed or filled by the deformed foam core 16). Steady state loading of the sole structure 10 occurs, for example, when a wearer (represented by foot 77 shown in phantom) is standing on the sole structure 10, but is not dynamically impacting the sole structure 10 against the ground G with at least a predetermined load.

In FIG. 5, the sole structure 10 is shown secured to a footwear upper 80 in the article of footwear 12. The footwear upper 80 may be a sock upper with sidewalls and a bottom, or may be secured to a strobel 82 at a lower periphery of the footwear upper 80. The footwear upper 80 and strobel 82 are secured to an inner side 84 of the foam core 16 such as with an adhesive layer 78. The inner side 49 of the peripheral wall 38 is secured to the first portion 62A, such as with an adhesive layer 78. In other embodiments, the peripheral wall 38 may be heat bonded or otherwise secured to the first portion 62A. An adhesive layer 78 may also be disposed at the interface of the bottom surface 56 of the foam core 16 and the top surface 58 of the midsole layer 20 as well as at the interface between the top surface 44 of the outsole component 18 and the bottom surface 42 of the midsole layer 20 to secure these respective surfaces to one another. No adhesive is disposed on the second portion 62B of the side surface 62, and no components are in contact with the second portion 62B during steady state loading (e.g., the second portion 62B is spaced apart from the peripheral wall 38 as shown in FIG. 5).

Referring to FIG. 6, the dynamic compressive loading of the wearer's foot 77 on the sole structure 10 is represented by load forces L. Under such loading, the foam core 16 may resiliently compress to provide cushioning and energy return. The first and third portions 62A, 62C are adhered and therefore fixed to the outsole component 18 during dynamic compression, but the second portion 62B is free to deform outward into the gap 76 without constraint at least until it interfaces with the inner side 49 of the peripheral wall 38 as shown in FIG. 6. After interfacing with the peripheral wall 38, the foam core 16 may continue to compress under the dynamic loading. However, compression of the foam core 16 at the second portion 62B is now influenced by the stiffness of the peripheral wall 38 which creates compressive reaction forces acting on the foam core 16 at the second portion 62B. The foam core 16 may have a first stiffness and the outsole component 18 may have a second stiffness greater than the first stiffness. Accordingly, the relatively compliant foam core 16 is protected from wear by the stiffer outsole component 18 by nesting the foam core 16 within the outsole component 18, and is allowed to resiliently deform transversely outward free from constraint of the peripheral wall 38 at the second portion 62B during a first stage of compressive loading prior to interfacing with the peripheral wall 38, and then may be influenced by reaction forces against the outsole component 18 during a second stage of compressive loading when it contacts the inner side 49 of the peripheral wall 38.

In embodiments that include a midsole layer 20 disposed between the bottom of the foam core 16 and the bottom wall 36 of the outsole component 18, the midsole layer 20 may have a greater stiffness than the foam core. Accordingly, the stiffness of the sole structure 10 under compressive loading may vary in that a lower stiffness may occur during the first stage of loading, and a greater stiffness may occur during the second stage of loading both transversely outward (due to the constraint of the peripheral wall 38) and in the vertical direction (due to the stiffer midsole layer 20).

With this configuration, foam core 16 is sufficiently secured to the outsole component 18 to ensure stability of the sole structure 10 while still allowing the foam core 16 to resiliently deform at the second portion 62B under loading without interference or constraint of the outsole component 18. Because the second portion 62B is below the first portion 62A which is restrained by the peripheral wall 38 even during the first stage of deformation, more of the dynamic movement of the foam core 16 (e.g., transversely outward resilient deformation of the foam core 16 into the gap 76) is closer to the ground G during wear, increasing stability of the sole structure 10.

Figure 9:
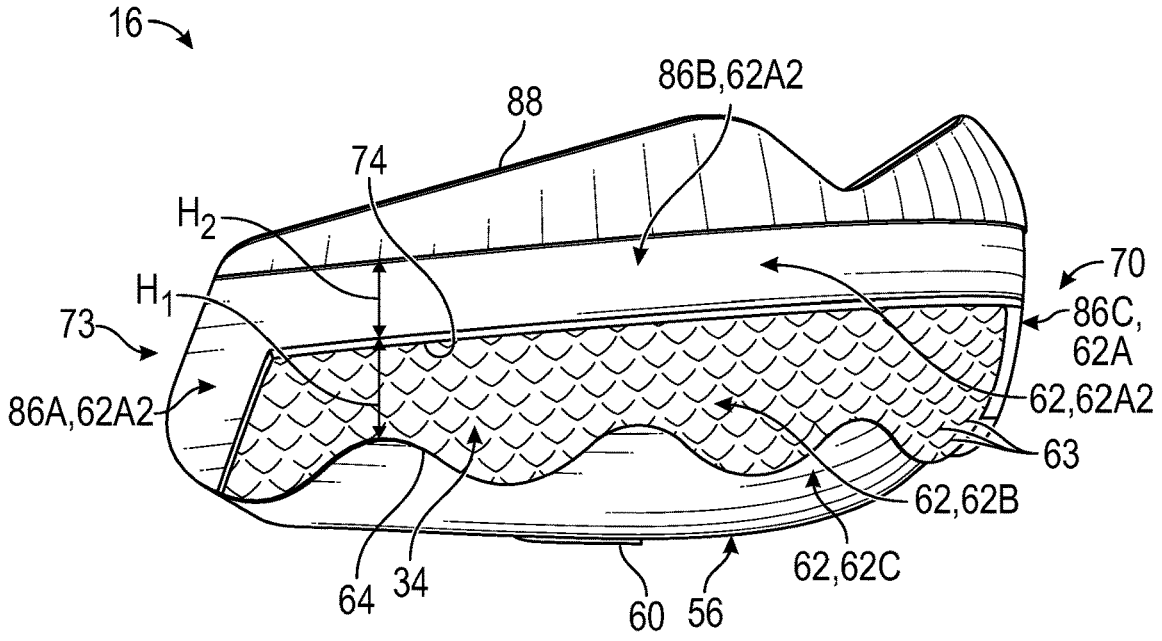
FIG. 9 is a side view of the lateral side of a foam core included in the sole structure.
Figure 11:
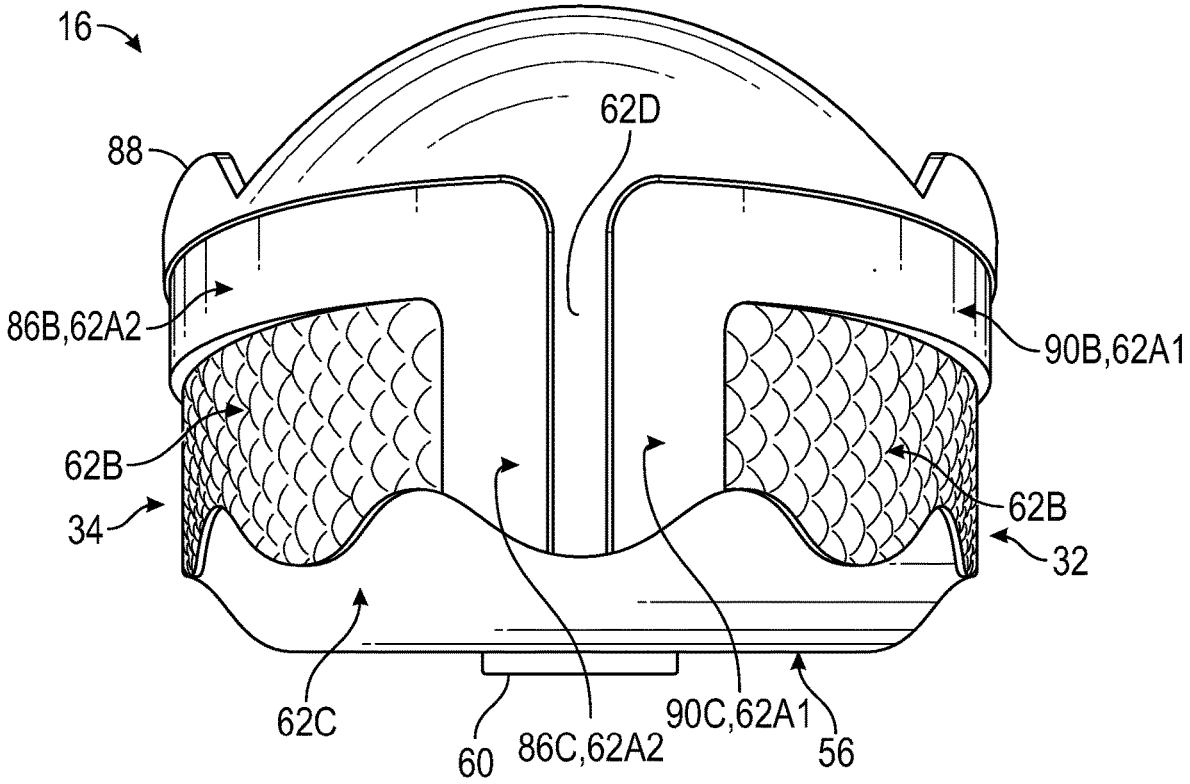
FIG. 11 is a rear view of the foam core.

The relative shapes and surface areas of the first portion 62A, the second portion 62B, and the third portion 62C may be different in various implementations. In the embodiment shown, the first portion 62A of the side surface 62 of the foam core 16 is configured as two elongated strips: a medial side elongated strip 62A1 on the medial side 32 from a front 73 of the foam core 16 and extending to the rear 70, and a lateral side elongated strip 62A2 on the lateral side 34 and extending from the front 73 of the foam core 16 to the rear 70. FIGS. 9 and 11 together show the lateral side elongated strip 62A2 includes a first leg 86A extending upward in a direction from the bottom surface 56 of the foam core 16 toward the top edge 88 of the foam core 16, a second leg 86B extending from the first leg 86A around the foam core 16 to the rear 70 of the foam core 16, and a third leg 86C extending from the second leg 86B downward toward the bottom surface 56 along the rear 70 of the foam core 16. The second portion 62B at the medial side 32 extends from the first leg 86A to the third leg 86C below the second leg 86B. The second portion 62B extends in an uninterrupted span between the first leg 86A and the third leg 86C below the second leg 86B. Additionally, a minimum height H1 of the second portion 62B below the second leg 86B (e.g., a distance to a peak of the waved edge 64 and in a direction perpendicular to a length of the second leg 86B of the first portion 62A) may be greater than a maximum height H2 of the second leg 86B (e.g., a distance across the second leg 86B in a direction perpendicular to the length of the second leg 86B), as shown in FIG. 9.

Figure 10:
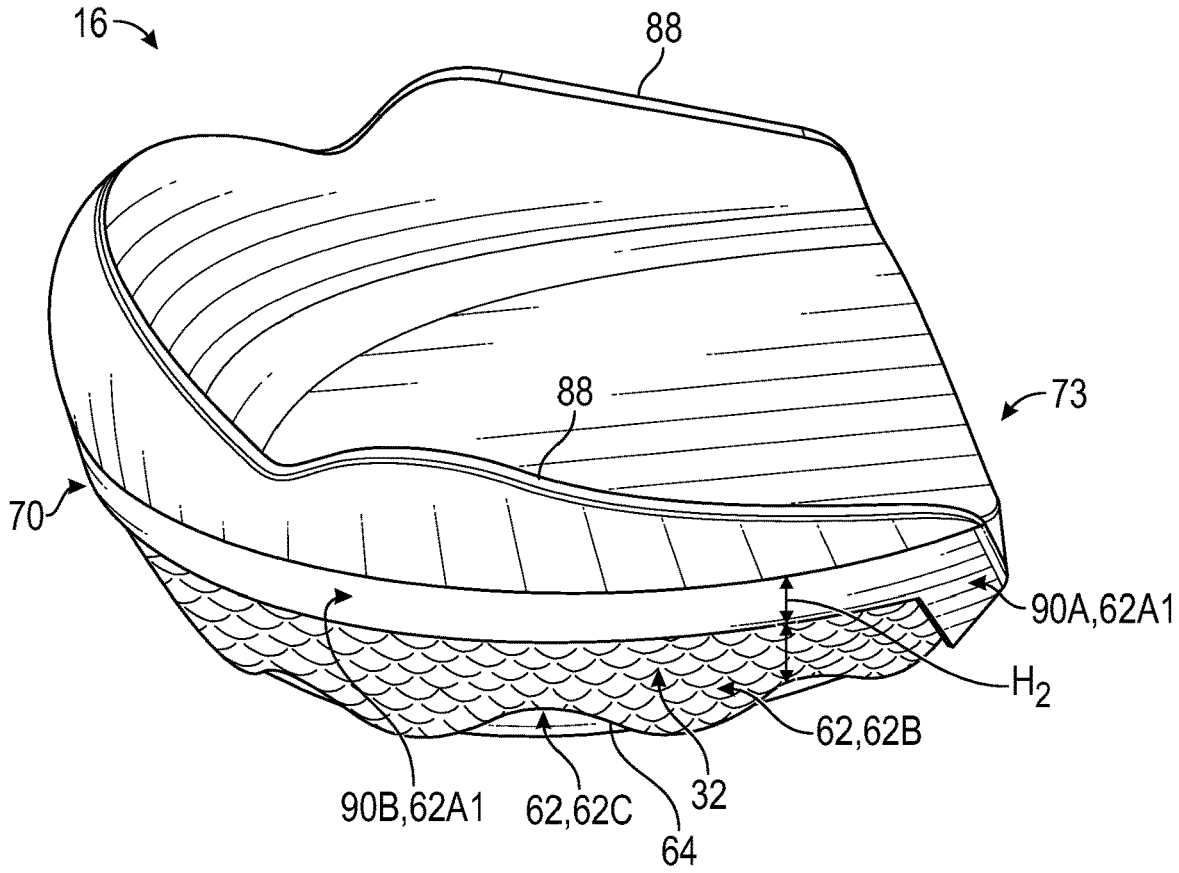
FIG. 10 is a perspective view showing the medial side of the foam core.

The medial side elongated strip 62A1 shown in FIGS. 10 and 11 also has a first leg 90A extending upward in the direction from the bottom surface 56 of the foam core 16 toward the top edge 88 of the foam core 16, a second leg 90B extending from the first leg 90A at the front 73 of the foam core 16 and around the foam core 16 to the rear 70 of the foam core 16, and a third leg 90C extending from the second leg 90B downward toward the bottom surface 56 along the rear 70 of the foam core 16. The second portion 62B at the lateral side 34 extends from the first leg 90A to the third leg 90C below the second leg 90B. The second portion 62B extends in an uninterrupted span between the first leg 90A and the third leg 90C. Additionally, a minimum height H1 of the second portion 62B below the second leg 90B (e.g., a distance to a peak of the waved edge 64 and in a direction perpendicular to a length of the second leg 90B of the first portion 62A) may be greater than a maximum height H2 of the second leg 90B (e.g., a distance across the second leg 90B in a direction perpendicular to the length of the second leg 90B), as shown in FIG. 10. The portion 62D of the side surface 62 of the foam core 16 that extends across the notch 61 of the outsole component 18 (shown in FIG. 4) inward of the peripheral wall 38 in the assembled sole structure 10 is between the third legs 86C, 90C, as shown in FIG. 11.

Accordingly, by configuring the first portion 62A as relatively narrow elongated strips 62A1, 62A2, the second portion 62B may have a relatively greater surface area than the first portion 62A to maximize that part of the foam core 16 able to resiliently deform unconstrained by the peripheral wall 38 during an initial phase of dynamic loading prior to contact with the peripheral wall 38, after which an effective stiffness at the second portion 62B will be greater due to the peripheral wall 38.

Figure 12:
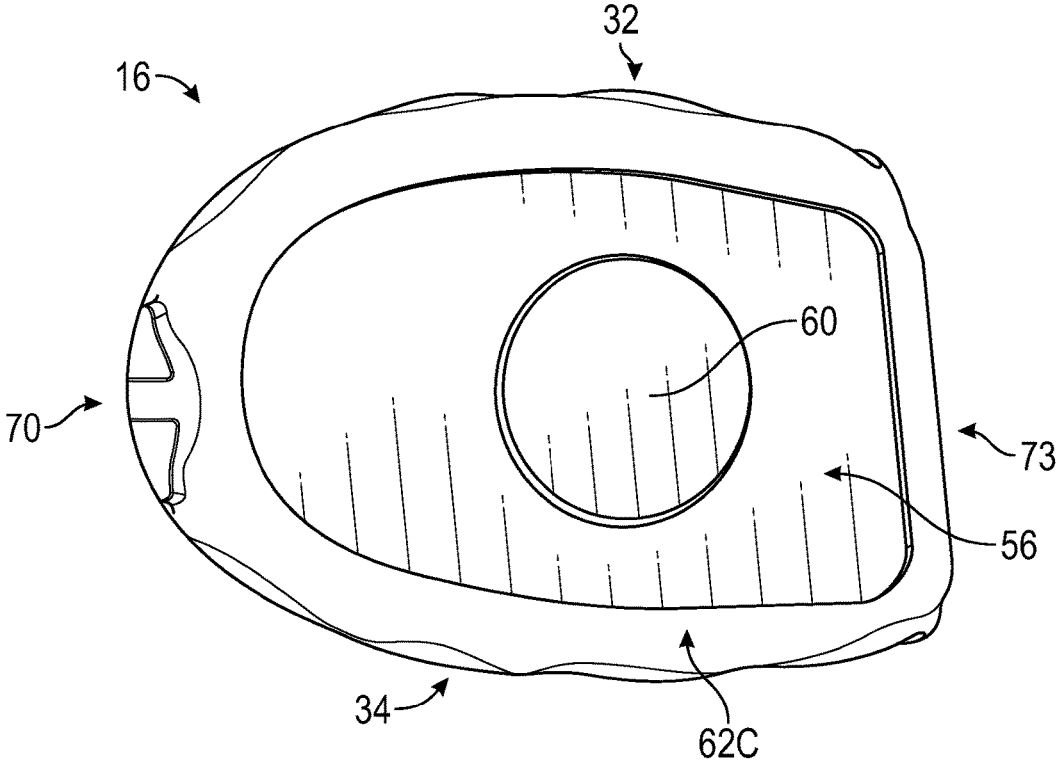
FIG. 12 is a bottom view of the foam core.

FIG. 12 is a bottom view of the foam core 16 showing the circular protrusion 60 at the bottom surface 56 that can be aligned with the through holes 46, 48 in the assembled sole structure 10, partially extending into the through hole 48 as shown in FIGS. 5 and 6.

Figure 13:
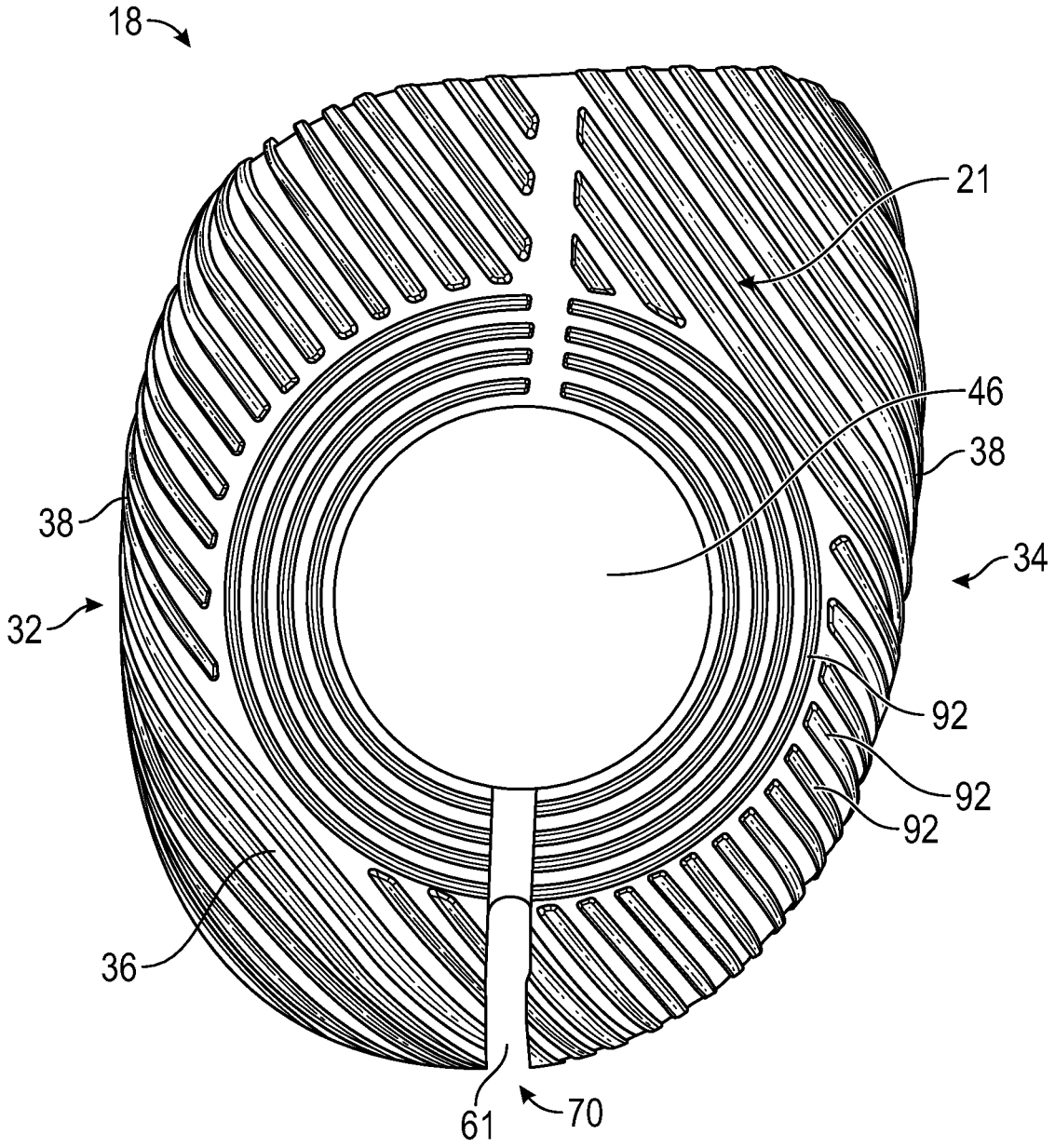
FIG. 13 is a bottom view of the outsole component.
Figure 14:
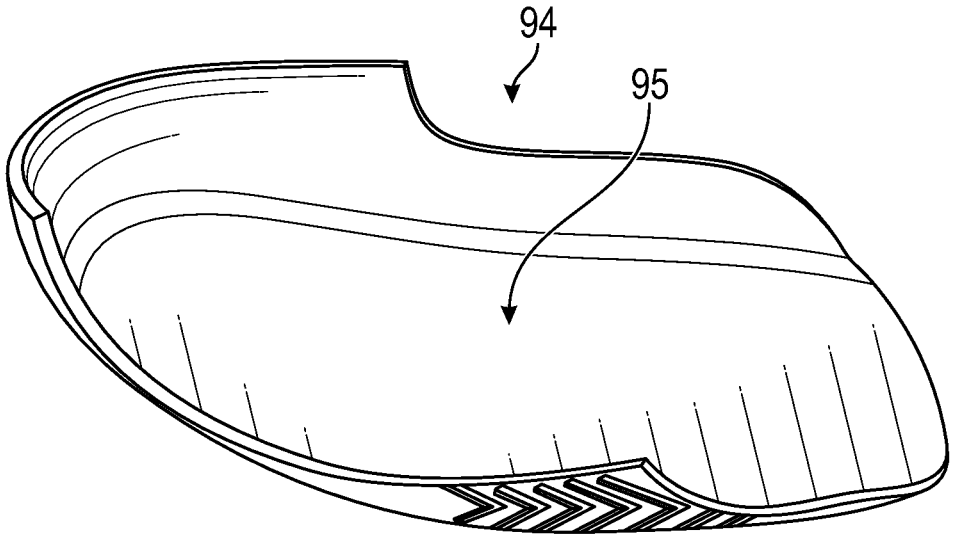
FIG. 14 is a perspective view of a front outsole component included in the sole structure.

FIG. 13 is a bottom view of the outsole component 18 showing a plurality of tread elements 92 at the ground-engaging surface 21. FIG. 14 is a perspective view of another outsole component 94 that can be included in the sole structure 10. More specifically, the outsole component 94 is configured as a forefoot outsole component, and an inner surface 95 of the outsole component 94 may be adhered to the bottom surface 42 of the midsole layer 20 in the forefoot region 28 (see FIG. 1). The forefoot outsole component 94 is disposed forward of the outsole component 18, which may be referred to as a heel outsole component 18.

Alternatively, a single (one-piece) outsole may be used, such as if the outsole components 94, 18 were formed together with the forward edge of the outsole component 18 extended forward to and integrated with the outsole component 94 at a rear extent of the outsole component 94.

Figure 15:
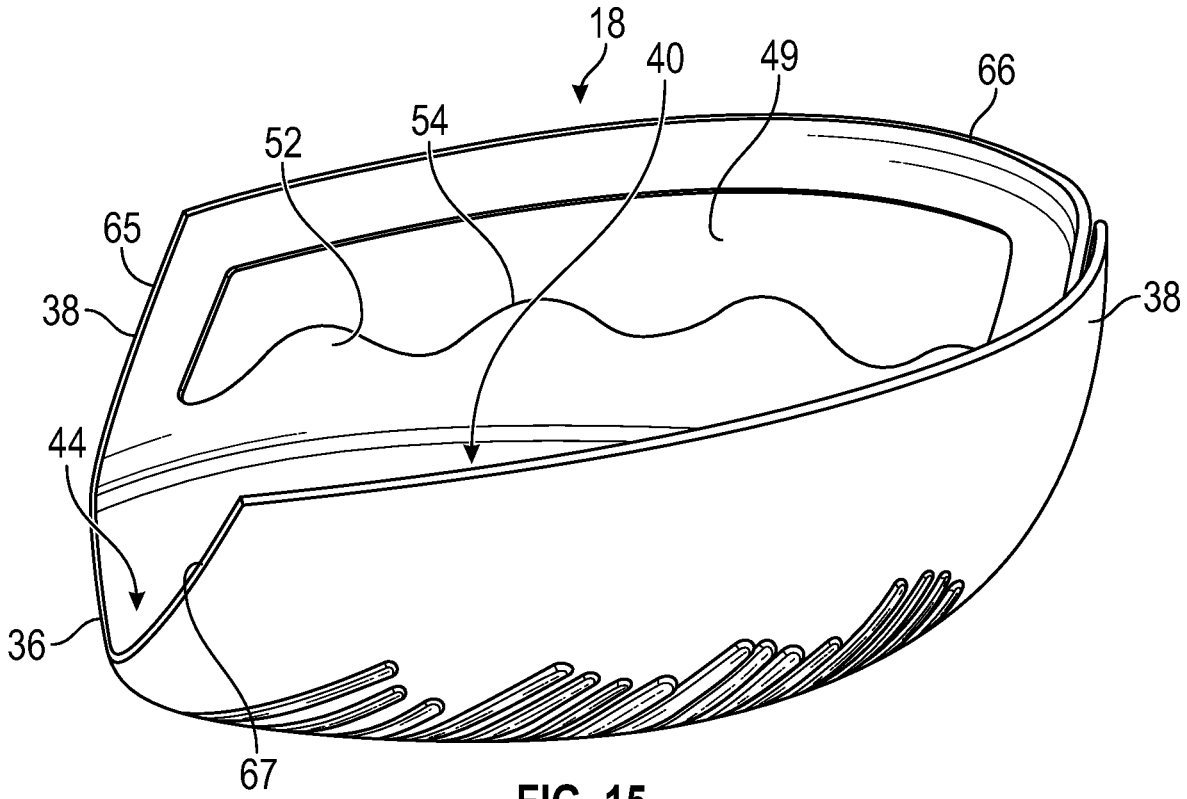
FIG. 15 is a perspective view of the outsole component of FIG. 13.
Figure 16:
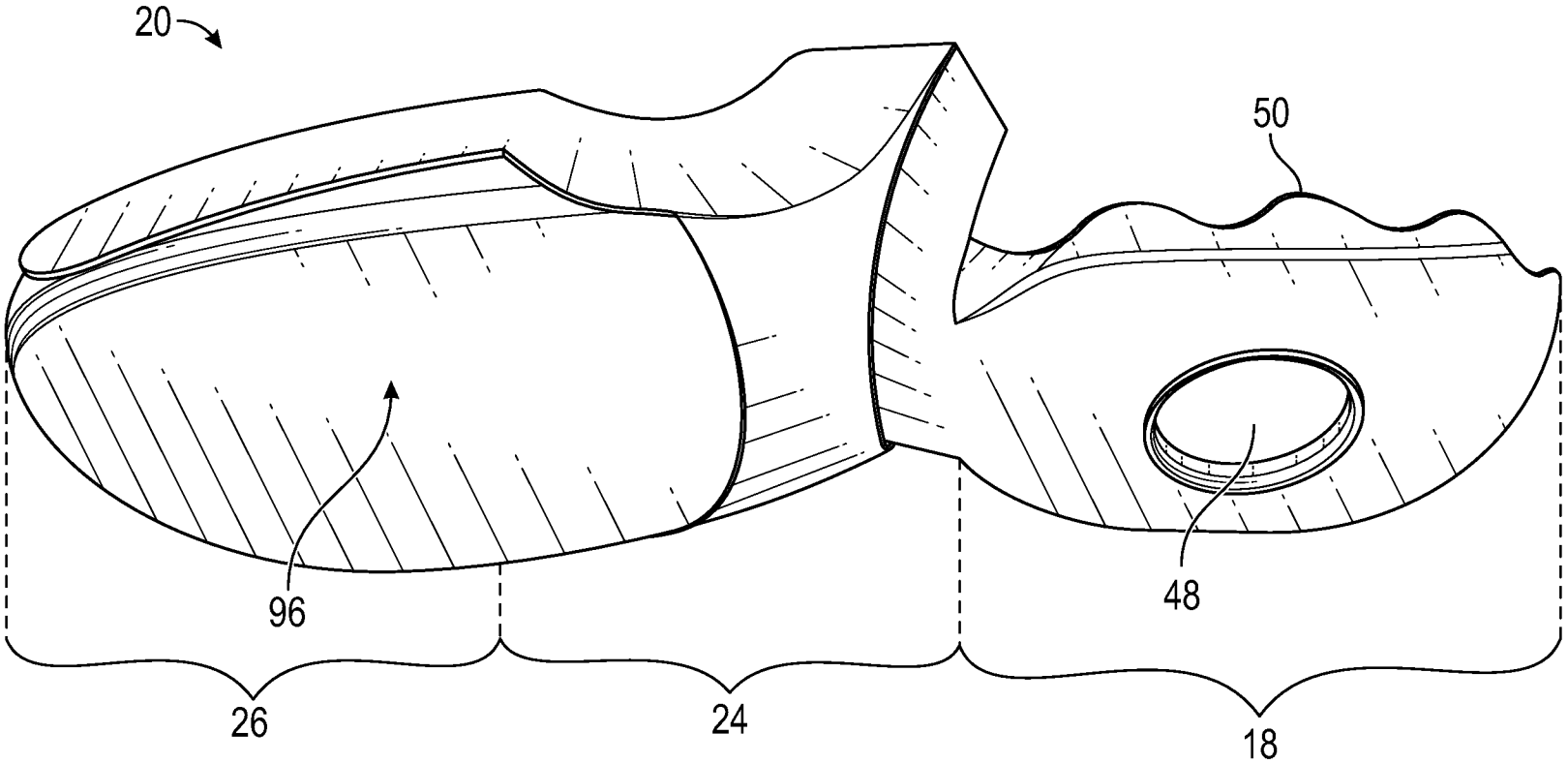
FIG. 16 is a bottom perspective view of the midsole layer.

FIG. 15 is a perspective view of the outsole component 18 and best shows the space 40 within which the foam core 16 (as well as the portion of the midsole layer 20 in the heel region 24) is nested in the assembled sole structure 10. FIG. 15 best shows the slight recess 52 having a waved edge 54 at an inner side 49 of the peripheral wall 38 to which the waved upper edge 50 of the midsole layer 20 (shown in bottom perspective view in FIG. 16) fits in the assembled sole structure 10.

Accordingly, the foam core 16 is protected from wear and abrasion in the space 40 formed by the outsole component 18 but the second portion 62B of the side surface 62 of the foam core 16 is allowed to resiliently deform transversely outward initially in an unrestrained manner due to the lack of attachment to any components and the gap 76. The attachment at the first portion 62A sufficiently secures the foam core 16 to the outsole component 18 for stability. The foam core may have a first stage of compression prior to the second portion 62B contacting the peripheral wall 38, and a second stage of compression after the second portion 62B contacts and is restrained by the peripheral wall 38. Additionally, if the midsole layer 20 is disposed between the foam core 16 and the outsole component 18, it may have a different compressive stiffness than the foam core 16, providing another stage of compression in the vertical direction.

The following Clauses provide example configurations of an article of footwear disclosed herein.

Clause 1. A sole structure for an article of footwear, the sole structure comprising: a sole component having a bottom wall and a peripheral wall extending upward from the bottom wall and partially surrounding a space above the bottom wall; and a midsole including a foam core nested in the space; wherein the peripheral wall of the sole component is disposed outward of a side surface of the foam core; and wherein the sole component is attached to a first portion of the side surface and is detached from a second portion of the side surface, the second portion of the side surface disposed between the first portion and the bottom wall.

Clause 2. The sole structure of clause 1, further comprising: an adhesive layer disposed on the first portion of the side surface of the foam core and adhering the sole component to the first portion of the side surface of the foam core, the second portion of the side surface free from any attachment within the space.

Clause 3. The sole structure of any of the preceding clauses, wherein: the second portion of the side surface of the foam core is recessed inward from the first portion, defining a gap between an inner side of the peripheral wall of the sole component and the second portion of the side surface of the foam core.

Clause 4. The sole structure of clause 3, wherein: the second portion of the side surface of the foam core resiliently deforms outward into the gap toward the inner side of the peripheral wall of the sole component under compressive loading.

Clause 5. The sole structure of any of the preceding clauses, wherein: the bottom wall of the sole component has a through hole and the foam core extends over the through hole.

Clause 6. The sole structure of any of the preceding clauses, wherein: the peripheral wall of the sole component extends adjacent to and outward of the side surface of the foam core at a medial side, a lateral side, and a rear of the sole structure.

Clause 7. The sole structure of any of the preceding clauses, wherein: the peripheral wall of the sole component has a notch extending from an upper edge of the peripheral wall to the bottom wall of the sole component at the rear of the foam core; and the foam core extends across the notch inward of the peripheral wall.

Clause 8. The sole structure of clause 7, wherein the peripheral wall and the bottom wall are an unitary structure and the peripheral wall is a continuous expanse from a front medial edge of the peripheral wall to the notch at a medial side of the sole component and from a front lateral edge of the peripheral wall to the notch at a lateral side of the sole component.

Clause 9. The sole structure of any of the preceding clauses, wherein: the first portion of the side surface of the foam core includes an elongated strip extending in a longitudinal direction of the sole structure above the second portion from a front of the foam core to a rear of the foam core.

Clause 10. The sole structure of any of the preceding clauses, wherein: the first portion of the side surface of the foam core includes an elongated strip that has a first leg extending from a bottom surface of the foam core toward a top edge of the foam core, a second leg extending from the first leg around the foam core to a rear of the foam core, and a third leg at the rear of the foam core and extending from the second leg toward the bottom surface of the foam core;

and the second portion extends from the first leg to the third leg between the second leg and the bottom surface of the foam core.

Clause 11. The sole structure of clause 10, wherein: the elongated strip is a medial side elongated strip at a medial side of the foam core, and the first portion of the side surface of the foam core further includes a lateral side elongated strip at a lateral side of the foam core, the lateral side elongated strip also having a first leg at the lateral side of the foam core and extending from the bottom surface of the foam core toward the top edge of the foam core, a second leg extending from the first leg around the foam core to the rear of the foam core, and a third leg at the rear of the foam core and extending from the second leg toward the bottom surface of the foam core; and the second portion of the lateral side elongated strip further extends from the first leg of the lateral side elongated strip to the third leg of the lateral side elongated strip between the second leg of the lateral side elongated strip and the bottom surface of the foam core at the lateral side of the foam core.

Clause 12. The sole structure of clause 10, wherein a minimum height of the second portion is greater than a maximum height of the second leg.

Clause 13. The sole structure of any of the preceding clauses, wherein: the foam core has a first stiffness and the sole component has a second stiffness greater than the first stiffness.

Clause 14. The sole structure of any of the preceding clauses, wherein the sole component is an outsole and includes a ground contact surface of the sole structure.

Clause 15. The sole structure of clause 14, further comprising: a midsole layer extending between a top surface of the sole component and a bottom surface of the foam core.

Clause 16. The sole structure of clause 15, wherein: the bottom surface of the foam core is secured to a top surface of the midsole layer; and a bottom surface of the midsole layer is secured to the top surface of the sole component.

Clause 17. The sole structure of clause 15, wherein: the foam core is disposed only in a heel region of the sole structure; and the midsole layer extends forward from between the foam core and the sole component in the heel region to a midfoot region and a forefoot region of the sole structure.

Clause 18. The sole structure of clause 17, wherein the sole component extends only in the heel region of the sole structure.

Clause 19. The sole structure of clause 15, wherein: the side surface of the foam core has a third portion below the second portion; the third portion is recessed inward from the second portion; and the midsole layer is bonded to the third portion of the side surface of the foam core.

Clause 20. The sole structure of clause 19, wherein: the side surface of the foam core defines a waved edge between the second portion and the third portion; and the midsole layer has a waved upper edge that mates with the waved edge of the side surface of the foam core.

Clause 21. A sole structure for an article of footwear, particularly in accordance with any of the preceding clauses, the sole structure comprising: an outsole having a bottom wall and a peripheral wall extending upward from the bottom wall and partially surrounding a space above the bottom wall, the peripheral wall forming a cup around a rear of a heel region of the sole structure from a medial side of the sole structure to a lateral side of the sole structure; and a midsole including a foam core nested in the space, the foam core having a side surface with a first portion and a second portion recessed inward from the first portion at both a medial side and a lateral side of the foam core defining a gap between an inner side of the peripheral wall of the outsole and the second portion of the foam core at each of the lateral side and the medial side of the foam core; wherein the midsole includes a midsole layer disposed between the foam core and the bottom wall of the outsole, the midsole layer secured to a bottom surface of the foam core and to a top surface of the bottom wall of the outsole; and wherein the peripheral wall of the outsole is disposed outward of the medial side of the foam core and outward of the lateral side of the foam core; and wherein the peripheral wall of the outsole is attached to the first portion of the side surface of the foam core at the medial side and the lateral side of the foam core, and is detached from the second portion of the side surface of the foam core at the medial side and the lateral side of the foam core.

Clause 22. The sole structure of clause 21, wherein the midsole layer is secured to a third portion of the side surface of the foam core between the second portion of the side surface of the foam core and the bottom wall of the outsole.

Clause 23. The sole structure of any of the preceding clauses, wherein: the first portion of the side surface of the foam core includes a medial side elongated strip extending in a longitudinal direction of the sole structure above the second portion from a front of the foam core to a rear of the foam core at the medial side of the foam core; and the first portion of the side surface of the foam core further includes a lateral side elongated strip extending in a longitudinal direction of the sole structure above the second portion from the front of the foam core to the rear of the foam core at the lateral side of the foam core.

Clause 24. The sole structure of clause 23, wherein the medial side elongated strip and the lateral side elongated strip each include: a first leg extending from a bottom surface of the foam core toward a top edge of the foam core, a second leg extending from the first leg around the foam core to the rear of the foam core, and a third leg extending from the second leg toward the bottom surface of the foam core; and the second portion extends from the first leg to the third leg between the second leg and the bottom surface of the foam core.

Clause 25. The sole structure of clause 24, wherein a minimum height of the second portion is greater than a maximum height of the second leg.

Clause 26. The sole structure of any of the preceding clauses, further comprising: an adhesive layer disposed on the first portion of the side surface of the foam core and adhering the outsole to the first portion of the side surface of the foam core, the second portion of the side surface free from any attachment within the space.

Clause 27. The sole structure of any of the preceding clauses, wherein: the second portion of the side surface of the foam core resiliently deforms outward into the gap toward the inner side of the peripheral wall of the outsole at both the lateral side and the medial side of the foam core under compressive loading.

Clause 28. The sole structure of any of the preceding clauses, wherein: the bottom wall of the outsole has a through hole and the foam core extends over the through hole.

Clause 29. The sole structure of any of the preceding clauses, wherein: the peripheral wall of the outsole has a notch extending from an upper edge of the peripheral wall to the bottom wall of the outsole at the rear of the foam core; and the foam core extends across the notch inward of the peripheral wall.

Clause 30. The sole structure of any of the preceding clauses, wherein: the foam core has a first stiffness and the outsole has a second stiffness greater than the first stiffness.

Clause 31. The sole structure of any of the preceding clauses, wherein: the foam core is disposed only in a heel region of the sole structure; and the midsole layer extends forward from between the foam core and the outsole in the heel region to a midfoot region and a forefoot region of the sole structure.

Clause 32. The sole structure of clause 31, wherein the outsole is a heel outsole component and extends only in a heel region of the sole structure; and the sole structure further comprises a forefoot outsole component extending under the midsole layer in the forefoot region of the sole structure.

Clause 33. The sole structure of any of the preceding clauses, wherein: the side surface of the foam core has a third portion below the second portion; the third portion is recessed inward from the second portion; and the midsole layer is bonded to the third portion of the side surface of the foam core.

Clause 34. The sole structure of clause 33, wherein: the side surface of the foam core defines a waved edge between the second portion and the third portion; and the midsole layer has a waved upper edge that mates with the waved edge of the side surface.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user.

Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A sole structure for an article of footwear, the sole structure comprising:

a sole component having a bottom wall and a peripheral wall extending upward from the bottom wall and partially surrounding a space above the bottom wall; and a midsole including a foam core nested in the space;

wherein, at a transverse cross-section of the sole structure, the peripheral wall of the sole component is disposed outward of an outermost exterior surface of the foam core;

wherein the sole component is attached to a first portion of the outermost exterior surface and is detached from a second portion of the outermost exterior surface, the second portion of the outermost exterior surface disposed between the first portion of the outermost exterior surface and the bottom wall, and at least partially higher than a top of a foot-supporting surface of the foam core;

wherein the second portion of the outermost exterior surface of the foam core is recessed inward from the first portion of the outermost exterior surface, defining an air gap between an inner side of the peripheral wall of the sole component and the second portion of the outermost exterior surface of the foam core; and wherein the air gap is disposed outward of the second portion of the outermost exterior surface of the foam core and inward of the inner side of the peripheral wall of the sole component.

2. The sole structure of claim 1, further comprising:

an adhesive layer disposed on the first portion of the outermost exterior surface of the foam core and adhering the sole component to the first portion of the outermost exterior surface of the foam core, the second portion of the outermost exterior surface free from any attachment within the space.

3. The sole structure of claim 1, wherein:

the second portion of the outermost exterior surface of the foam core resiliently deforms outward into the air gap toward the inner side of the peripheral wall of the sole component under compressive loading to at least partially fill the air gap.

4. The sole structure of claim 1, wherein:

the bottom wall of the sole component has a through hole and the foam core extends over the through hole.

5. The sole structure of claim 1, wherein:

the peripheral wall of the sole component extends adjacent to and outward of the outermost exterior surface of the foam core at a medial side, a lateral side, and a rear of the sole structure.

6. The sole structure of claim 5, wherein:

the peripheral wall of the sole component has a notch extending from an upper edge of the peripheral wall to the bottom wall of the sole component at the rear of the foam core; and the foam core extends across the notch inward of the peripheral wall and the outermost exterior surface of the foam core that is inward of the sole component is exposed only at the notch.

7. The sole structure of claim 1, wherein:

the first portion of the outermost exterior surface of the foam core includes an elongated strip extending in a longitudinal direction of the sole structure above the second portion of the outermost exterior surface from a front of the foam core to a rear of the foam core.

8. The sole structure of claim 1, wherein:

the first portion of the outermost exterior surface of the foam core includes an elongated strip that has a first leg extending from a bottom surface of the foam core toward a top edge of the foam core, a second leg extending from the first leg around the foam core to a rear of the foam core, and a third leg at the rear of the foam core and extending from the second leg toward the bottom surface of the foam core; and the second portion of the outermost exterior surface extends from the first leg to the third leg between the second leg and the bottom surface of the foam core.

9. The sole structure of claim 8, wherein a minimum height of the second portion is greater than a maximum height of the second leg.

10. The sole structure of claim 1, wherein:

the foam core has a first stiffness and the sole component has a second stiffness greater than the first stiffness.

11. The sole structure of claim 1, wherein the sole component is an outsole and includes a ground contact surface of the sole structure.

12. The sole structure of claim 11, further comprising:

a midsole layer extending between a top surface of the sole component and a bottom surface of the foam core.

13. The sole structure of claim 12, wherein:

the bottom surface of the foam core is secured to a top surface of the midsole layer; and a bottom surface of the midsole layer is secured to the top surface of the sole component.

14. The sole structure of claim 12, wherein:

the foam core is disposed only in a heel region of the sole structure; and the midsole layer extends forward from between the foam core and the sole component in the heel region to a midfoot region and a forefoot region of the sole structure.

15. The sole structure of claim 12, wherein:

the outermost exterior surface of the foam core has a third portion below the second portion;

the third portion is recessed inward from the second portion; and the midsole layer is bonded to the third portion of the outermost exterior surface of the foam core.

16. The sole structure of claim 15, wherein:

the outermost exterior surface of the foam core defines a waved edge between the second portion and the third portion; and the midsole layer has a waved upper edge that mates with the waved edge of the outermost exterior surface of the foam core.

17. A sole structure for an article of footwear, the sole structure comprising:

an outsole having a bottom wall and a peripheral wall extending upward from the bottom wall and partially surrounding a space above the bottom wall, the peripheral wall forming a cup around a rear of a heel region of the sole structure from a medial side of the sole structure to a lateral side of the sole structure; and a midsole including a foam core nested in the space;

wherein, at a transverse cross-section of the sole structure, the foam core has an outermost exterior surface;

wherein the outermost exterior surface of the foam core includes a first portion and a second portion recessed inward from the first portion at both a medial side and a lateral side of the foam core defining an air gap between an inner side of the peripheral wall of the outsole and the second portion of the outermost exterior surface of the foam core at each of the lateral side and the medial side of the foam core, the air gap outward of the second portion of the outermost exterior surface of the foam core and inward of the inner side of the peripheral wall of the sole component;

wherein the second portion of the outermost exterior surface of the foam core is disposed at least partially higher than a top of a foot-supporting surface of the foam core;

wherein the midsole includes a midsole layer disposed between the foam core and the bottom wall of the outsole, the midsole layer secured to a bottom surface of the foam core and to a top surface of the bottom wall of the outsole;

wherein the peripheral wall of the outsole is disposed outward of the medial side of the foam core and outward of the lateral side of the foam core; and wherein the peripheral wall of the outsole is attached to the first portion of the outermost exterior surface of the foam core at the medial side and the lateral side of the foam core, and is detached from the second portion of the outermost exterior surface of the foam core at the medial side and the lateral side of the foam core.

18. The sole structure of claim 17, wherein the midsole layer is secured to a third portion of the outermost exterior surface of the foam core between the second portion of the outermost exterior surface of the foam core and the bottom wall of the outsole.

19. The sole structure of claim 17, wherein:

the foam core is disposed only in a heel region of the sole structure; and the midsole layer extends forward from between the foam core and the outsole in the heel region to a midfoot region and a forefoot region of the sole structure.

* * * * *